US006499615B1

(12) United States Patent
Szieff et al.

(10) Patent No.: US 6,499,615 B1
(45) Date of Patent: Dec. 31, 2002

(54) ANGLED CAP AND VENT FOR USE WITH A BABY BOTTLE

(76) Inventors: William K. Szieff, 2406 Lofty View Dr., Torrance, CA (US) 90505; Richard C. G. Dark, 2248 Gum Tree La., Fallbrook, CA (US) 92028

( * ) Notice: Subject to any disclaimer, the term of this patent is extended or adjusted under 35 U.S.C. 154(b) by 0 days.

(21) Appl. No.: 09/952,877

(22) Filed: Sep. 11, 2001

(51) Int. Cl.[7] ..... A61J 11/02
(52) U.S. Cl. ..... 215/11.5; 215/11.1; 215/386
(58) Field of Search ..... 215/11.1, 11.4, 215/11.5, 386, 388; 222/464.4, 464.6

(56) References Cited

U.S. PATENT DOCUMENTS

| | | | | | |
|---|---|---|---|---|---|
| 280,656 | A | | 7/1883 | Morris | |
| 380,835 | A | * | 4/1888 | Ware | 215/11.5 X |
| 593,830 | A | | 11/1897 | Borgenschild | |
| 1,280,942 | A | | 10/1918 | Apple | |
| 1,950,702 | A | | 3/1934 | Thoma | |
| 2,467,463 | A | | 4/1949 | Canham et al. | |
| 2,877,917 | A | * | 3/1959 | Brooks et al. | 215/11.5 |
| 3,044,650 | A | * | 7/1962 | Oltion et al. | 215/11.5 |
| 3,704,803 | A | * | 12/1972 | Ponder | 215/11.5 |
| 4,676,387 | A | | 6/1987 | Stephenson et al. | |
| 4,801,027 | A | | 1/1989 | Hunter | |
| 4,832,213 | A | | 5/1989 | Sharon et al. | |
| 4,867,325 | A | | 9/1989 | Dransfield | |
| 4,925,042 | A | | 5/1990 | Chong | |
| 4,940,152 | A | * | 7/1990 | Lin | 215/11.5 |
| D309,781 | S | | 8/1990 | Sharon et al. | |
| 4,969,564 | A | | 11/1990 | Cohen et al. | |
| D316,754 | S | | 5/1991 | Lau | |
| 5,024,341 | A | | 6/1991 | Dekerle | |
| 5,190,174 | A | | 3/1993 | Klag | |
| 5,211,298 | A | * | 5/1993 | Bloch | 215/11.5 X |
| 5,269,425 | A | | 12/1993 | Gomez-Acevedo | |
| 5,433,328 | A | | 7/1995 | Baron et al. | |
| D371,849 | S | | 7/1996 | Thom | |
| 5,551,583 | A | | 9/1996 | Sachathamakul et al. | |
| D376,430 | S | | 12/1996 | Humphrey et al. | |
| 5,588,548 | A | | 12/1996 | Brankley | |
| 5,638,968 | A | | 6/1997 | Baron et al. | |
| D382,969 | S | | 8/1997 | Giles et al. | |
| 5,669,520 | A | | 9/1997 | Simpson | |
| 5,678,710 | A | * | 10/1997 | Sheu | 215/11.5 |
| D389,583 | S | | 1/1998 | Thom | |
| 5,779,071 | A | | 7/1998 | Brown et al. | |
| D404,832 | S | | 1/1999 | Laskey et al. | |
| D405,537 | S | | 2/1999 | Bonds | |
| D413,983 | S | | 9/1999 | Shaw et al. | |
| D414,268 | S | | 9/1999 | Shaw et al. | |
| 6,068,147 | A | * | 5/2000 | Sheu | 215/11.5 |
| D428,154 | S | | 7/2000 | Shaw et al. | |
| D428,496 | S | | 7/2000 | Thom et al. | |
| 6,092,681 | A | | 7/2000 | Shaw et al. | |

* cited by examiner

*Primary Examiner*—Lee Young
(74) *Attorney, Agent, or Firm*—Eric Karich

(57) ABSTRACT

A combination angled cap and vent for connecting a baby bottle with a nipple has an angled cap and a vent tube. The angled cap has an elbow shaped body, a proximal opening, and a distal opening. The proximal opening of the angled cap communicates with the distal opening so that liquid from the baby bottle is transmitted to the nipple. The elbow shaped body is shaped to maintain the proximal opening in non-coaxial alignment with the distal opening. The proximal opening includes an externally threaded portion adapted to threadedly receive a retaining cap that functions to lock the nipple over the proximal opening. The distal opening includes an internally threaded portion adapted to threadedly engage the baby bottle. The angled cap further includes a vent aperture through the angled cap adjacent the proximal opening. The vent tube has an inlet end and an outlet end, the inlet end being in fluid communication with the vent aperture, and the outlet end being positioned to extend upwardly through the distal opening. The vent tube includes a check valve for allowing fluid flow from the inlet end to the outlet end, but preventing fluid flow from the outlet end to the inlet end.

5 Claims, 3 Drawing Sheets

ANGLED CAP AND VENT FOR USE WITH A BABY BOTTLE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to baby bottles, and more particularly to an angled cap and vent that is attached between a baby bottle and a nipple.

2. Description of Related Art

The following art defines the present state of this field:

Brankley, U.S. Pat. No. 5,588,548, teaches an adjustable baby bottleneck for connecting a conventional baby bottle to a conventional rubber nipple through an angular or adjustable bottleneck portion. The angularly adjustable bottleneck portion may be set and fixed from an angle of 0 to 60 degrees and includes a mounting securing ring at one end for mating with the top of a standard nursing bottle and at the other end includes means for mating with a standard nipple.

Gomez-Acevedo, U.S. Pat. No. 5,269,425 teaches a nursing bottle which allows the intercommunication of at least two closed compartments to mix the contents thereof without any contact with the outside environment.

Chong, U.S. Pat. No. 4,925,042 teaches a handle which is in the shape of a hollow tube whereof one end engages onto a nipple and the other end is engageable to a mounting flange on the bottle top wherein it provides a junction of flexibility between the nipple and bottle.

Hunter, U.S. Pat. No. 4,801,027 teaches a child's drinking cup or bottle, with the cup or bottle having a generally rigid cap upon which there is mounted a relatively soft drinking lip or teat. The cap can mount the teat at an angle.

B. Doner, U.S. Pat. No. 3,071,272 teaches a baby feeding bottle with an air bleeding means that does not flood with the fluid being used and thus eliminates the need to allow air to feed back to the nipple of the bottle during use.

W. G. Canham et al., U.S. Pat. No. 2,467,463 teaches a novel and improved baby's nursing unit of simple construction which is provided with automatic pressure equalizing means for providing a substantial continuous flow of fluid to the baby while nursing and wherein the baby may be fed with its head in a comfortable position.

G. C. Apple, U.S. Pat. No. 1,280,942 teaches a flanged cap constituting a cover for a drinking vessel such as a cup, glass or the like.

C. Borgenschild, U.S. Pat. No. 593,830 teaches the combination with a bottle, of a cap adapted to fit thereon and having an opening therethrough surrounded by an upwardly-projecting interiorly-screw-threaded thimble, and air-admitting openings exterior to the thimble.

J. A. Morris, U.S. Pat. No. 280,656 teaches a nipple made to hold a glass tube which extends downward to near the bottom of the bottle, and has a free gravitating movement adapted to any inclination of he bottle, the nipple at the same time being firmly secured to the bottle by an exterior flange or cap or by another portion of the nipple.

Brown et al., U.S. Pat. No. 5,779,071, teaches an air venting system assembly that can be positioned within a bottle to enable air to vent into the bottle.

Giles et al., U.S. Des. Pat. No. 382,969 teaches a combined baby nurser and cap.

The prior art teaches baby bottles with angled or adjustable necks or caps. The prior art also teaches venting systems that vent air into the bottle. However, the prior art does not teach a combination angled cap and vent connecting a baby bottle with a nipple. The present invention fulfills these needs and provides further related advantages as described in the following summary.

SUMMARY OF THE INVENTION

The present invention teaches certain benefits in construction and use which give rise to the objectives described below.

The present invention provides a combination angled cap and vent for connecting a baby bottle with a nipple. The combination includes an angled cap having an elbow shaped body, a proximal opening, and a distal opening. The proximal opening of the angled cap communicates with the distal opening so that liquid from the baby bottle is transmitted to the nipple. The elbow shaped body is shaped to maintain the proximal opening in non-coaxial alignment with the distal opening. The angled cap includes a means for removably connecting the proximal opening with the nipple and a means for removably connecting the distal opening with the baby bottle. The angled cap further includes a vent aperture through the angled cap adjacent the proximal opening. The combination further includes a vent tube having an inlet end and an outlet end, the inlet end being in fluid communication with the vent aperture, and the outlet end being positioned to extend upwardly through the distal opening. The vent tube includes a check valve means for allowing fluid flow from the inlet end to the outlet end, but preventing fluid flow from the outlet end to the inlet end.

A primary objective of the present invention is to provide combination angled cap and vent for connecting a baby bottle with a nipple, the combination having advantages not taught by the prior art.

Another objective is to provide an angled cap that enables a baby to be held upright while feeding from the baby bottle, thereby maintaining the baby's ear canal above his or her mouth and helping to prevent the baby from getting an ear infection.

A further objective is to provide a venting system that enables air to vent directly into the baby bottle through the vent and without bubbling through the fluid that the baby is drinking.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
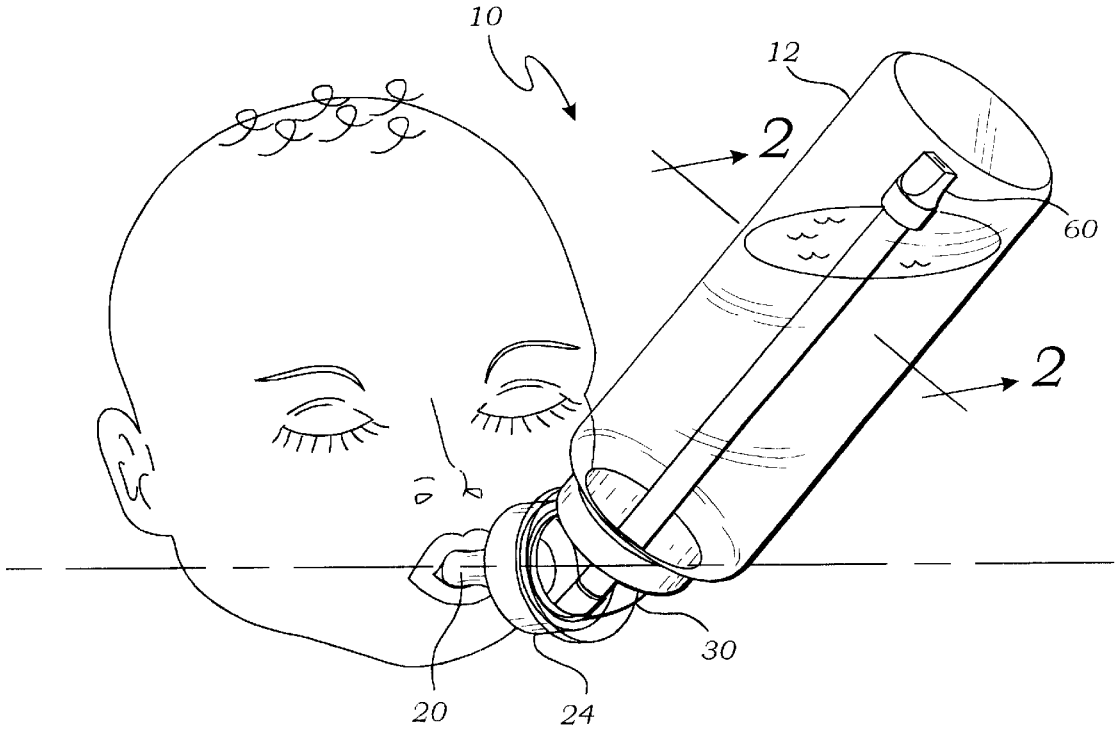
FIG. 1 is a perspective view of the preferred embodiment of the present invention being used to feed a baby.

The above described drawing figures illustrate the invention, a combination angled cap and vent 10 for connecting a baby bottle 12 with a nipple 20. The combination 10 includes an angled cap 30 having an elbow shaped body 32, a proximal opening 34, and a distal opening 36. The proximal opening 34 of the angled cap 30 communicates with the distal opening 36 so that liquid from the baby bottle 12 is transmitted to the nipple 20. The elbow shaped body 32 is shaped to maintain the proximal opening 34 in non-coaxial alignment with the distal opening 36. The angled cap 30 includes a means for removably connecting the proximal opening 34 with the nipple 20. The angled cap 30 also includes a means for removably connecting the distal opening 36 with the baby bottle 12. The angled cap 30 further includes a vent aperture 50 through the angled cap 30 adjacent the proximal opening 34. The combination 10 further includes a vent tube 52 having an inlet end 54 and an outlet end 56, the inlet end 54 being in fluid communication with the vent aperture 50, and the outlet end 56 being positioned to extend upwardly through the distal opening 36. The vent tube 52 includes a check valve means 60 for allowing fluid flow from the inlet end 54 to the outlet end 56, but preventing fluid flow from the outlet end 56 to the inlet end 54.

As shown in FIG. 1, the angled cap 30 has the elbow shaped body 32 between the proximal opening 34 and the distal opening 36 so that the proximal opening 34 is maintained in non-coaxial alignment with the distal opening 36. The distal opening 36 is positioned approximately 10–90 degrees, most preferably approximately 45 degrees, out of coaxial alignment with the proximal opening 34, to enable the baby to be held upright while feeding from the baby bottle 12, thereby maintaining the baby's ear canal above his or her mouth and helping to prevent the baby from getting an ear infection. The specific angle of the angled cap 30 can be varied by those skilled in the art as long as the angle is suitable to protect the baby from an ear infection as described above. The angled cap 30 is preferably constructed of molded plastic, and is most preferably transparent so that one can visually determine how much liquid is in the angled cap 30 when the baby is drinking from the baby bottle 12.

Figure 2:
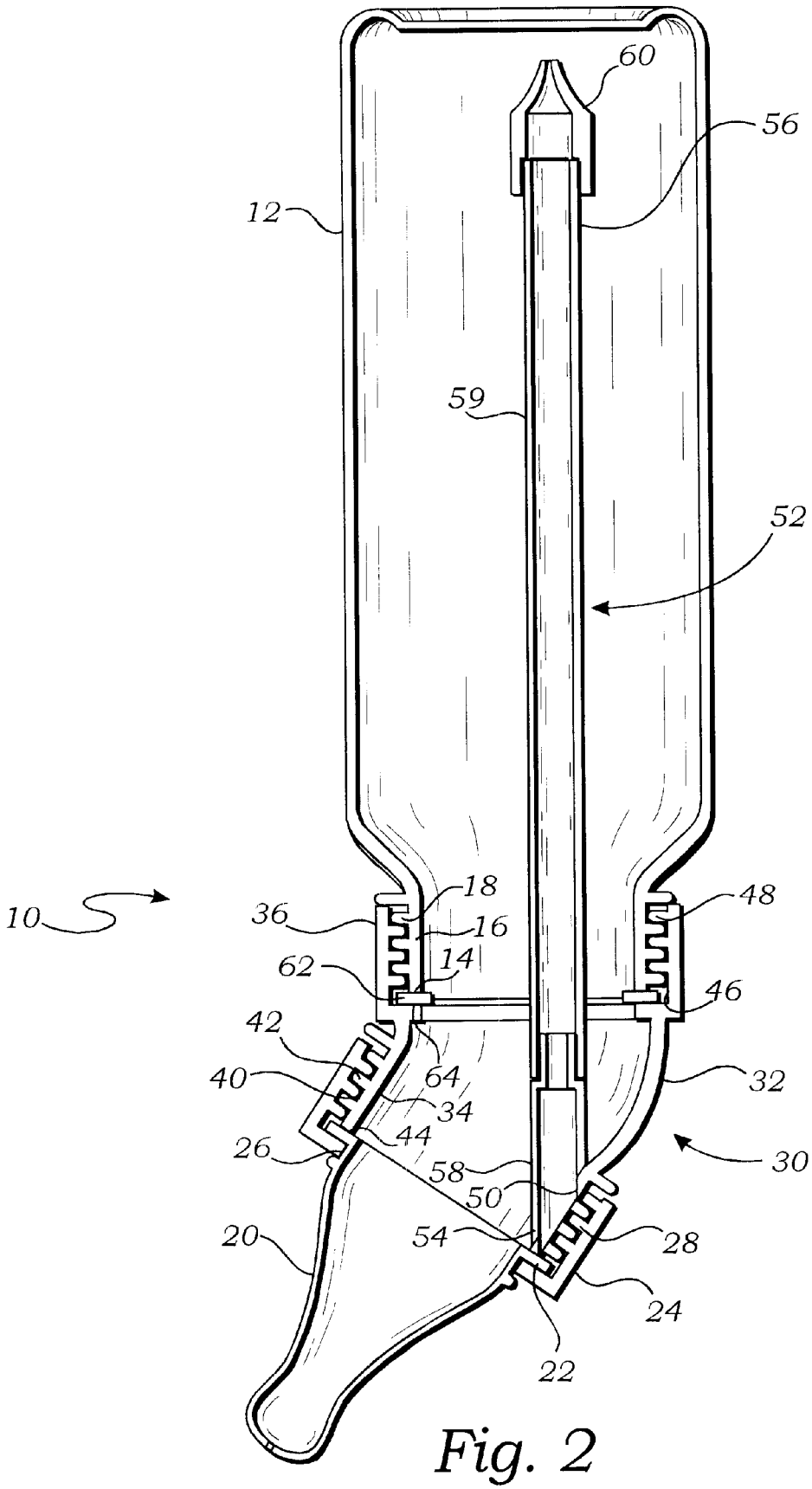
FIG. 2 is a sectional view thereof taken along line 2—2 in FIG. 1.
Figure 3:
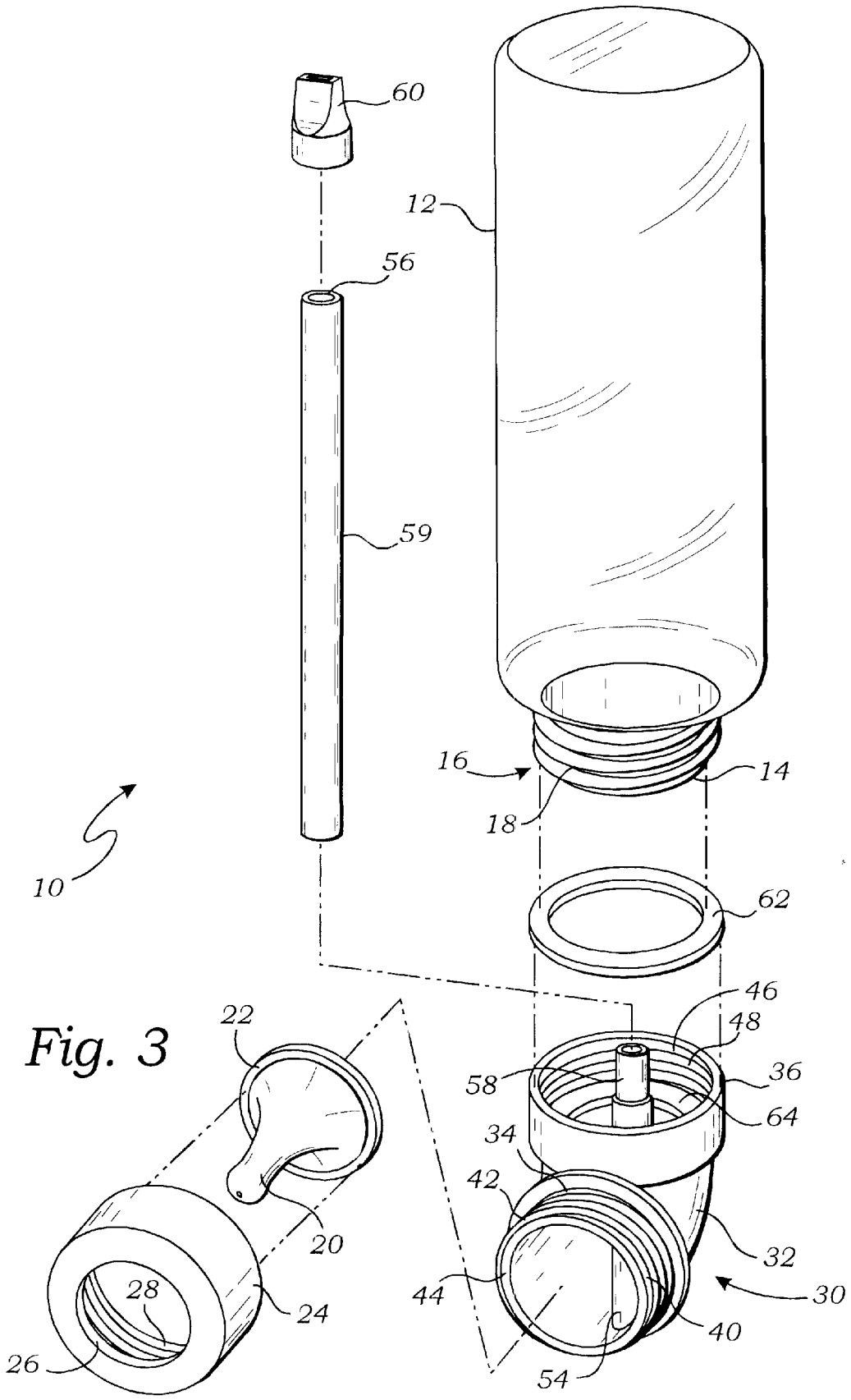
FIG. 3 is an exploded perspective view thereof.

As shown in FIGS. 2 and 3, the means for removably connecting the proximal opening 34 with the nipple 20 is preferably provided by an externally threaded portion 40 of the proximal opening 34. The externally threaded portion 40 includes an external thread 42 that is adapted to threadedly engage an internally threaded cap portion 28 of a retaining cap 24. A proximal perimeter 44 of the proximal opening 34 is adapted to conform to a nipple flange 22 of the nipple 20 such that the nipple 20 functionally seals the proximal opening 34 when the nipple 20 is positioned through a central aperture 26 of the retaining cap 24, the nipple flange 22 is positioned against the proximal perimeter 44, and the retaining cap 24 is used to locked the nipple flange 22 down against the proximal perimeter 44. This arrangement is equivalent with various alternative structures, including an alternative nipple (not shown) in which the retaining cap 24 is integral with the nipple 20 so that the nipple 20 does not include a flange that contacts the proximal perimeter 44.

As shown in FIGS. 2 and 3, the means for removably connecting the distal opening 36 with the baby bottle 12 is preferably provided by an internally threaded portion 46 of the distal opening 36. The internally threaded portion 46 has an internal thread 48 that is adapted to threadedly engage the externally threaded bottle portion 18 of the baby bottle 12. While the threaded engagements shown herein are the preferred embodiments of the means for removably connecting the proximal and distal openings 34 and 36 can be provided by equivalent locking mechanisms known to those skilled in the art.

As shown in FIG. 2, the combination 10 includes a vent aperture 50 through the externally threaded portion 40. As shown in FIGS. 2 and 3, the vent aperture 50 is in fluid communication with an inlet end 54 of a vent tube 52. The vent tube 52 has an outlet end 56 opposite the inlet end 54. The outlet end 56 is positioned to extend upwardly through the distal opening 36 such that the outlet end 56 can be positioned near the bottom of the baby bottle 12 when the combination 10 is operably mounted upon the baby bottle 12. The vent tube 52 is preferably a plastic tube that includes a lower tube portion 58 and an upper tube portion 59. The lower tube portion 58 is preferably integral with the angled cap 30. The upper tube portion 59 is preferably frictionally engageable with the lower tube portion 58 so that the upper tube portion 59 can be connected with the lower tube portion 58 to form a single tube. The ability to divide the vent tube 52 into two parts makes shipping and storage of the combination 10 easier, and it also facilitates cleaning of the combination 10, a critical concern since the combination 10 is used for feeding babies.

As shown in FIGS. 1–3, the combination 10 further includes a check valve means 60 for allowing fluid flow from the inlet end 54 to the outlet end 56, but preventing fluid flow from the outlet end 56 to the inlet end 54. The check valve means 60 is preferably a duck bill valve 60 constructed of a resilient material such as rubber and operably positioned over the outlet end 56 of the vent tube 52.

In the preferred embodiment, as shown in FIGS. 2 and 3, the combination 10 also includes a rubber washer 62 that is adapted to be operably positioned in a washer receiving portion 64 of the distal opening 36. The rubber washer 62 is adapted to form a seal between the bottle perimeter 16 and the distal opening 36. Of course, other materials that are equivalent to rubber, including plastics and other resilient and fluid-proof materials, may be used and should be considered within the scope of the enclosed claims.

In use, the upper tube portion 59 is frictionally connected to the lower tube portion 58 to form the vent tube 52. The rubber washer 62 is positioned in the washer receiving portion 64, the vent tube 52 is positioned within the baby bottle 12, and the angled cap 30 is attached to the baby bottle 12, preferably by threadedly engaging the internally threaded cap portion 28 with the externally threaded bottle portion 18. The angled cap 30 is tightened until the bottle perimeter 16 abuts the rubber washer 62 and firmly clamps the rubber washer 62 against the washer receiving portion 64, thereby sealing the distal opening 36 around the bottle aperture 14.

The nipple 20 is then positioned through the central aperture 26 of the retaining cap 24 such that the nipple flange 22 abuts the retaining cap 24. Of course, some nipples 20 are integrally formed with the retaining cap 24, so this step is not required. It is considered that integrally forming the nipple flange 22 with the retaining cap 24 is equivalent to the structure described as the preferred embodiment herein, so a more detailed description of the alternative structure is not provided. The retaining cap 24 is then attached to the proximal opening 34 of the angled cap 30, preferably by threadedly engaging the externally threaded portion 40 of the angled cap 30 with the internally threaded cap portion 28.

Once assembled, as shown in FIG. 2, the internally threaded cap portion 28 serves to exclude dirt from entering the vent aperture 50, while allowing air to enter the baby bottle 12 by passing around the external thread 42, through the vent aperture 50, through the vent tube 52, through the duck bill valve 60, and into the baby bottle 12, when the baby suckles on the nipple 20. The duck bill valve 60 and the length of the vent tube 52, together, prevent the liquid from draining through the vent tube 52 and out of the baby bottle 12 when the baby bottle 12 is inverted.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination angled cap and vent for connecting a baby bottle with a nipple, the combination comprising:

an angled cap having an elbow shaped body, a proximal opening, and a distal opening, the proximal opening communicating with the distal opening, the elbow shaped body maintaining the proximal opening in non-coaxial alignment with the distal opening;

a means for removably connecting the proximal opening with the nipple;

a means for removably connecting the distal opening with the baby bottle;

a vent aperture through the angled cap adjacent the proximal opening;

a vent tube having an inlet end and an outlet end, the inlet end being in fluid communication with the vent aperture, and the outlet end being positioned to extend upwardly through the distal opening; and a check valve means for allowing fluid flow from the inlet end to the outlet end, but preventing fluid flow from the outlet end to the inlet end.

2. A combination angled cap and vent for connecting a baby bottle with a nipple and a retaining cap, the baby bottle having a bottle aperture having a bottle perimeter and an externally threaded bottle portion, the nipple having a nipple flange, the retaining cap having a central aperture and an internally threaded cap portion, the combination comprising:

an angled cap having an elbow shaped body, a proximal opening, and a distal opening, the proximal opening communicating with the distal opening, the elbow shaped body maintaining the proximal opening in non-coaxial alignment with the distal opening;

an externally threaded portion of the proximal opening having an external thread, the externally threaded portion being adapted to threadedly engage the internally threaded cap portion of the retaining cap;

a proximal perimeter of the proximal opening adapted to conform to the nipple flange such that the nipple seals the proximal opening when positioned against the proximal perimeter;

an internally threaded portion of the distal opening having an internal thread, the internally threaded portion being adapted to threadedly engage the externally threaded bottle portion of the baby bottle;

a vent aperture through the externally threaded portion;

a vent tube having an inlet end and an outlet end, the inlet end being in fluid communication with the vent aperture, and the outlet end being positioned to extend upwardly through the distal opening; and a check valve means for allowing fluid flow from the inlet end to the outlet end, but preventing fluid flow from the outlet end to the inlet end.

3. The combination of claim 2 further comprising a rubber washer operably positioned in a washer receiving portion of the distal end, the rubber washer being adapted to form a seal between the bottle perimeter and the distal opening.

4. The combination of claim 2 wherein the check valve means is a duck bill valve operably positioned over the outlet end of the vent tube.

5. The combination of claim 2 wherein the vent tube includes a lower tube portion and an upper tube portion, the lower tube portion being integral with the angled cap, and the upper tube portion being frictionally engageable with the lower tube portion.

* * * * *